US010293383B2

(12) United States Patent
Krauter et al.

(10) Patent No.: US 10,293,383 B2
(45) Date of Patent: May 21, 2019

(54) MOBILE HIGH-PRESSURE CLEANING APPARATUS

(71) Applicant: Alfred Kärcher GmbH & Co. KG, Winnenden (DE)

(72) Inventors: Ronald Krauter, Korb (DE); Andreas Pfizenmaier, Auenwald (DE); Stefan Ehrhardt, Winnenden (DE); Torsten Kern, Wurmlingen (DE); Ulrich Bauer, Pfullingen (DE)

(73) Assignee: Alfred Kärcher SE Co. KG, Winnenden (DE)

( * ) Notice: Subject to any disclaimer, the term of this patent is extended or adjusted under 35 U.S.C. 154(b) by 10 days.

(21) Appl. No.: 15/407,844

(22) Filed: Jan. 17, 2017

(65) Prior Publication Data

US 2017/0120305 A1 May 4, 2017

Related U.S. Application Data

(63) Continuation of application No. PCT/EP2014/065523, filed on Jul. 18, 2014.

(51) Int. Cl.
*B08B 3/02* (2006.01)
*B08B 13/00* (2006.01)

(52) U.S. Cl.
CPC ..... *B08B 3/02* (2013.01); *B08B 3/026* (2013.01); *B08B 13/00* (2013.01); *B08B 2203/007* (2013.01); *B08B 2203/0211* (2013.01); *B08B 2203/0217* (2013.01); *B08B 2203/0241* (2013.01); *B08B 2203/0276* (2013.01)

(58) Field of Classification Search
CPC ..... B08B 3/02; B08B 13/00; B08B 2203/007; B08B 2203/0211; B08B 2203/0217; B08B 2203/0241; B08B 2203/0276
USPC ..... 134/95.1, 95.3, 105, 107, 123, 172, 184, 134/198
See application file for complete search history.

(56) References Cited

U.S. PATENT DOCUMENTS 3,018,968 A 1/1962 Levey
3,481,544 A 12/1969 Jackson
(Continued)

FOREIGN PATENT DOCUMENTS

AU 2009250988 7/2010
DE 198 06 400 8/1999
(Continued)

*Primary Examiner* — Levon J Shahinian
(74) *Attorney, Agent, or Firm* — Womble Bond Dickinson (US) LLP

(57) ABSTRACT

A mobile high-pressure cleaning apparatus is provided with a vehicle trailer, on the chassis of which at least two running wheels are held so as to be rotatable, and with a high-pressure cleaning appliance having a motor and a pump, and also with at least one water storage tank for storing water for the high-pressure cleaning appliance. So that water can be provided to the apparatus from the at least one water storage tank or from a water supply mains, without risk of water from the water supply mains being returned thereto, the high-pressure cleaning apparatus has a decoupling tank with at least one inlet which can be connected to the water supply mains, and at least one outlet which is connected to the high-pressure cleaning appliance and to at least one water supply tank via a shut-off member which can be actuated by the user.

16 Claims, 8 Drawing Sheets

(56) References Cited

U.S. PATENT DOCUMENTS

| | | | |
|---|---|---|---|
| 3,522,909 | A | 8/1970 | Arant |
| 3,556,402 | A | 1/1971 | Wolking |
| 4,109,340 | A | 8/1978 | Bates |
| 4,284,127 | A | 8/1981 | Collier et al. |
| 4,336,627 | A | 6/1982 | Bascus |
| 4,443,909 | A | 4/1984 | Cameron |
| 4,862,551 | A | 9/1989 | Martinez et al. |
| 4,940,082 | A | 7/1990 | Roden |
| 4,949,424 | A | 8/1990 | Shero |
| 5,004,156 | A | 4/1991 | Montanier |
| 5,366,154 | A | 11/1994 | Thompson |
| 5,662,269 | A | 9/1997 | Francis |
| 6,061,868 | A | 5/2000 | Moritsch et al. |
| 6,109,346 | A | 8/2000 | Hill |
| 8,038,081 | B2 | 10/2011 | Hendy |
| 2003/0041407 | A1 | 3/2003 | Savage |
| 2007/0061996 | A1 | 3/2007 | Boone |
| 2007/0095370 | A1 | 5/2007 | Kratser |
| 2008/0035304 | A1 | 2/2008 | Roden et al. |
| 2009/0200787 | A1 | 8/2009 | Schatz et al. |
| 2010/0294459 | A1 | 11/2010 | Williams |
| 2011/0143541 | A1 | 6/2011 | Ogawa et al. |
| 2013/0087175 | A1* | 4/2013 | Petter ..... B08B 3/003 134/36 |
| 2014/0054015 | A1 | 2/2014 | Boehm et al. |

FOREIGN PATENT DOCUMENTS

| | | |
|---|---|---|
| DE | 198 55 772 | 6/2000 |
| DE | 10 2007 018 249 | 10/2008 |
| EP | 0 615 791 | 9/1994 |
| EP | 0 962 263 | 12/1999 |
| EP | 1 746 360 | 1/2007 |
| FR | 2 724 126 | 3/1996 |
| GB | 616094 | 1/1949 |
| WO | WO 00/35329 | 6/2000 |
| WO | WO 2008/068490 | 6/2008 |
| WO | WO 2010/136331 | 12/2010 |

* cited by examiner

MOBILE HIGH-PRESSURE CLEANING APPARATUS

CROSS-REFERENCE TO RELATED APPLICATIONS

This application is a continuation of international application number PCT/EP2014/065523 filed on Jul. 18, 2014, which is incorporated herein by reference in its entirety and for all purposes.

BACKGROUND OF THE INVENTION

The invention relates to a mobile high-pressure cleaning apparatus with a vehicle trailer, on the chassis of which at least two running wheels are held so as to be rotatable about a common axis of rotation for moving the high-pressure cleaning apparatus, and with a high-pressure cleaning appliance having a motor and a pump driven by the motor for pressurizing water which can be directed at an object which is to be cleaned, and also with at least one water storage tank for storing water for the high-pressure cleaning appliance.

By means of such a high-pressure cleaning apparatus, water can be pressurized and directed at an object which is to be cleaned. The high-pressure cleaning apparatus for this purpose has a high-pressure cleaning appliance with a pump which is driven by a motor.

The high-pressure cleaning apparatus can be used at different operating sites, in particular on construction sites. If a water supply mains is available at the operating sites, the high-pressure cleaning appliance can be supplied with water from the water supply mains. A water supply mains is however not available at all operating sites. The high-pressure cleaning apparatus therefore has at least one water storage tank for storing water for the high-pressure cleaning appliance. The water storage tank may have a volume of several hundred liters, for example a volume of 300 liters or 500 liters. The at least one water storage tank can be filled with water at a collection point, and then the high-pressure cleaning apparatus can be driven to a desired operating site. At the operating site, the high-pressure cleaning appliance can be supplied with water from the at least one water storage tank.

When the high-pressure cleaning appliance is connected to a public water supply mains, the mains network operator frequently demands that it be ensured by suitable measures that water taken from the water supply mains cannot unintentionally be returned back into the water supply mains. This is intended to ensure that the water supply mains does not come into contact with possibly contaminated water.

It is an object of the present invention to develop a mobile high-pressure cleaning apparatus of the generic type such that the high-pressure cleaning appliance can be provided either with water from the at least one water storage tank or from a water supply mains, there being no risk of water taken from the water supply mains being able to be fed to the water supply mains again.

SUMMARY OF THE INVENTION

This object is achieved in a mobile high-pressure cleaning apparatus of the type referred to first hereinbefore according to the invention in that the high-pressure cleaning apparatus has a decoupling tank with at least one inlet which can be connected to a water supply mains and with at least one outlet which is connected to the high-pressure cleaning appliance and to at least one water supply tank via at least one shut-off member which can be actuated by the user.

In the configuration according to the invention, the water taken from the water supply mains does not pass directly into a water storage tank or to the high-pressure cleaning appliance, but passes initially into a decoupling tank. From the decoupling tank, the water can then flow to the high-pressure cleaning appliance. Furthermore, the water can pass from the decoupling tank also to a water supply tank, it being necessary for this for the user to open a shut-off member which in the closed state breaks the connection between the decoupling tank and the water storage tank. If the shut-off member is opened, the water storage tank can be filled via the decoupling tank.

If a water supply mains is available at the operating site of the high-pressure cleaning apparatus, the high-pressure cleaning appliance can be connected directly to the water supply mains via the decoupling tank, without the flow connection between the high-pressure cleaning appliance and the water supply mains having to take place via a water storage tank. It is therefore not imperative to fill the at least one water storage tank in order to use the high-pressure cleaning apparatus. Filling is only necessary when there is no water supply mains at the operating site and thus the at least one water storage tank has to be filled with water beforehand at a collection point, for example in a builder's yard, via the decoupling tank.

It is beneficial if a filling-level-dependent valve, for example a float valve, is arranged at the inlet of the decoupling tank. The water is supplied from the water supply mains to the decoupling tank via the filling-level-dependent valve. This makes it possible to ensure in a structurally simple manner that water can be taken from the water supply mains only until the decoupling tank has reached a maximum filling level.

The decoupling tank beneficially forms a water chamber which decouples the high-pressure cleaning appliance and the at least one water storage tank from the water supply mains. From the water supply mains, the water initially flows into the decoupling tank, the inlet thereof being arranged above the maximum filling level of the decoupling tank, so that the water in the decoupling tank can no longer flow back to the inlet and via it to the water supply mains.

It is particularly advantageous if the decoupling tank is integrated in a water storage tank. This permits a particularly compact configuration of the high-pressure cleaning apparatus.

For example, provision may be made for a water storage tank to have an indentation which forms the decoupling tank. The decoupling tank is thus molded into a water storage tank.

Beneficially, the decoupling tank together with a water storage tank is configured as a one-part molded plastics part.

The high-pressure cleaning apparatus according to the invention has a vehicle trailer and is adapted to be pulled by a towing vehicle. The vehicle trailer, as is conventional, has a drawbar with which it can be coupled to the towing vehicle, and also a chassis, on which the at least one water storage tank and the high-pressure cleaning appliance are arranged.

In a preferred configuration of the invention, the high-pressure cleaning apparatus has a first water storage tank and a second water storage tank which are arranged spaced apart from each other in each case on a long side of the vehicle trailer and are connected together via a line arrangement, the two water storage tanks being located on the chassis and the high-pressure cleaning appliance being positioned between the two water storage tanks on the chassis. By means of such an arrangement, a relatively low center of gravity for the high-pressure cleaning apparatus can be achieved, and the low center of gravity in turn results in improved handling, in particular in curves and when braking and accelerating the high-pressure cleaning apparatus.

Before driving the high-pressure cleaning apparatus to an operating site, the two water storage tanks can be filled with water. In many cases, this is however not necessary, since a water supply mains is available at the desired operating site, to which mains the high-pressure cleaning appliance can be connected via the decoupling tank. If the two water storage tanks are not filled with water during the journey of the high-pressure cleaning apparatus, they have a relatively low weight and the position of the center of gravity of the high-pressure cleaning apparatus is determined substantially by the position of the high-pressure cleaning appliance. Since the high-pressure cleaning appliance preferably assumes a position between the two water storage tanks on the chassis, the high-pressure cleaning apparatus has a relatively low center of gravity. Should it be necessary to fill the two water storage tanks before the high-pressure cleaning apparatus is driven to an operating site, since no water supply mains is available at the desired operating site, then despite the considerable weight of the water storage tank a low center of gravity can be achieved since the water storage tanks are located on the chassis. Even when the water storage tanks are filled, the high-pressure cleaning apparatus has improved handling.

The use of two water storage tanks spaced apart from each other furthermore has the advantage that the water storage tanks can be produced inexpensively in molding processes from plastics material, it being possible for the water storage tanks to be demolded transversely to the longitudinal direction of the chassis. The demolding in the transverse direction makes it easy to mold receptacles for accessory parts and operating components of the high-pressure cleaning apparatus into the water storage tanks, the receptacles preferably opening into the sides of the water storage tanks which face each other.

The two water storage tanks may for example be produced by a rotational sintering process.

One further advantage of arranging the two water storage tanks in each case on a long side of the vehicle trailer on the chassis and of positioning the high-pressure cleaning apparatus and optionally further components of the high-pressure cleaning apparatus between the two water storage tanks on the chassis is that the high-pressure cleaning appliance and possibly further components of the high-pressure cleaning apparatus are accessible to the user and optionally also to the service personnel in a simple manner for operating the high-pressure cleaning apparatus and for maintenance measures. The assembly of the high-pressure cleaning apparatus is also facilitated thereby.

It is particularly advantageous if the decoupling tank is integrated in the first water storage tank and is connected via a supply line to the high-pressure cleaning appliance and via a first connecting line which can be shut off to the second water storage tank, and if the second water storage tank is connected via a second connecting line to the first water storage tank. If a water supply mains is available at the operating site of the high-pressure cleaning apparatus, the inlet of the decoupling tank can be connected to the water supply mains via an inlet hose. From the decoupling tank, the water taken from the water supply mains can be provided to the high-pressure cleaning appliance via a supply line. A first connecting line which connects the decoupling tank to the second water storage tank can be shut off, so that the second water storage tank is not in a flow connection with the water supply mains. If however the two water storage tanks are to be filled with water at a collection point, the first connecting line can be unblocked, so that the water flowing into the decoupling tank can be provided to the second water storage tank via the first connecting line and also to the first water storage tank via a second connecting line. At the operating site, the water can pass out of the water storage tanks via the two connecting lines and the supply line to the high-pressure cleaning appliance.

Since the decoupling tank is in a flow connection via the first connecting line with the second water storage tank, which in turn is connected via a second connecting line to the first water storage tank, the decoupling tank and the two water storage tanks form a communicating system and the filling level of the decoupling tank is identical to the filling level of the two water storage tanks, as long as the flow connection between the decoupling tank and the second water storage tank is unblocked.

Provision may be made for the space between the two water storage tanks to be directly accessible both on the front side of the high-pressure cleaning apparatus, i.e. at the front in the direction of travel, and on the rear side of the high-pressure cleaning apparatus, that is to say at the rear in the direction of travel.

In an advantageous embodiment, the chassis has a frame on which the two water storage tanks are located. Provision may for example be made for the frame of the chassis to have two longitudinal spars which are oriented parallel to the direction of travel of the high-pressure cleaning apparatus and on which one water storage tank is located directly in each case. The two longitudinal spars may be connected together rigidly via transverse spars of the frame.

A particularly low center of gravity and hence particularly good handling are obtained in an advantageous embodiment of the invention in that the two water storage tanks extend over the entire length of the chassis. The great longitudinal extent of the two water storage tanks makes it possible to provide a relatively large tank volume at a low height. Despite a considerable tank volume, a low center of gravity can be achieved.

It is advantageous if the two water storage tanks relative to the direction of travel have in each case a front tank region and a rear tank region, the volume of the front tank region being less than the volume of the rear tank region. The front tank region may extend from the front end of the water storage tanks to approximately the common axis of rotation of the two running wheels, and the rear tank region may adjoin the front tank region and extend as far as the rear end of the water storage tanks. The provision of a smaller volume for the front tank region makes it possible to keep the vertical load of the drawbar relatively low even when the water storage tanks are filled. For example, provision may be made for the vertical load of the drawbar not to amount to more than 75 kg even when the water storage tanks are filled.

In an advantageous configuration, the front and the rear tank region have the same width, that is to say the horizontal extent transversely to the direction of travel of the high-pressure cleaning apparatus is the same for both tank regions, but the vertical extent of the front tank region is less than the vertical extent of the rear tank region.

As already mentioned, the provision of two water storage tanks arranged spaced apart from each other permits simple demolding of the water storage tanks transversely to the direction of travel. This makes it possible in particular to mold recesses for accessory parts and/or operating components into the water storage tanks, the recesses of the one water storage tank facing the other water storage tank. The recesses may be configured as indentations.

In an advantageous embodiment, at least one of the two water storage tanks has, facing the other water storage tank, at least one recess which forms a receptacle for an accessory part. The recess may for example form a receptacle for storing a jet pipe, a spray gun, a jet pipe extension, operating instructions, a safety helmet and/or a hose.

In order to achieve a particularly powerful cleaning action, it is advantageous if the pressurized water which is to be directed at the object to be cleaned can be heated. For this purpose, the high-pressure cleaning apparatus according to the invention in an advantageous embodiment has a heating unit for heating the water pressurized by the pump, the heating unit being arranged between the two water storage tanks on the chassis. The heating unit may be of considerable weight, and owing to the positioning of the heating unit between the two water storage tanks a low center of gravity can be achieved for the mobile high-pressure cleaning apparatus despite the use of the heating unit, whereby the handling can be improved.

The heating unit is advantageously configured as a fuel-operated continuous-flow heater. Such continuous-flow heaters are known to the person skilled in the art for example from WO 2012/152313 A1.

In an advantageous configuration of the invention, a fuel tank, a cleaning-agent tank and/or an antifreeze tank are arranged between the two water storage tanks. In the fuel tank fuel, for example diesel fuel or light heating oil, for a heating unit of the high-pressure cleaning apparatus can be stored. A liquid cleaning agent, for example a soap solution, may be stored in the cleaning-agent tank. The cleaning agent may be admixed to the water delivered by the pump of the high-pressure cleaning appliance in order to increase the cleaning action. In the antifreeze tank, an antifreeze can be stored with which the water-receiving components of the high-pressure cleaning apparatus, i.e. in particular the high-pressure cleaning appliance and high-pressure and/or inlet hoses connected thereto, can be protected from frost damage if the high-pressure cleaning apparatus is rendered inoperative in the cold season. The fuel tank, the cleaning-agent tank and/or the antifreeze tank can be arranged in the region between the two water storage tanks. For example, provision may be made for the fuel tank, the cleaning-agent tank and/or the antifreeze tank to be able to be placed on a baseplate which is located directly on the chassis. The aforementioned tanks are accessible to the user in a simple manner.

In particular, provision may be made for the fuel tank, the cleaning-agent tank and/or the antifreeze tank to be accessible to the user from the rear side of the high-pressure cleaning apparatus.

In an advantageous configuration of the invention, a high-pressure hose wound onto a hose drum and/or an inlet hose wound onto a hose drum are arranged between the two water storage tanks. The high-pressure hose may be connected to an exit from the pump of the high-pressure cleaning appliance, so that the pressurized water can be directed at an object via the high-pressure hose. For example a spray lance or a spray gun can be connected to the free end of the high-pressure hose. The inlet hose may be used in order to connect the inlet of the decoupling tank to a water supply mains. The high-pressure hose and the inlet hose, when not in use, can each be wound on a hose drum which can be positioned between the two water storage tanks.

Beneficially, the hose drum for the high-pressure hose and/or the hose drum for the inlet hose are accessible to the user from the rear side of the high-pressure cleaning apparatus.

It is advantageous if an electric switch cabinet and/or a storage surface for a toolbox are arranged between the two water storage tanks. In particular electrical control components, display equipment and switches of the high-pressure cleaning apparatus may be positioned in the electric switch cabinet, and for example also electric fuses. The arrangement of the switch cabinet between the two water storage tanks is advantageous in particular when the electric switch cabinet is accessible to the user from the rear side of the high-pressure cleaning apparatus. This facilitates handling of the high-pressure cleaning apparatus and also the assembly and maintenance thereof.

A toolbox can also beneficially be positioned between the two water storage tanks and be accessible to the user from the rear side of the high-pressure cleaning apparatus. To this end, a storage surface for the toolbox can be provided between the two water storage tanks.

In a particularly preferred configuration of the invention, the high-pressure cleaning apparatus has at least one cover which is movable back and forth between a closed position and an open position, which in the closed position covers a region between the two water storage tanks and uncovers this region in the open position, and which is mounted movably on the two water storage tanks.

For example, a cover in the closed position may cover the high-pressure cleaning appliance and a heating unit, and uncover them for maintenance measures in the open position. Preferably this cover in the closed position covers a front region, relative to the direction of travel, of the high-pressure cleaning apparatus between the two water storage tanks.

Provision may also be made for a cover in the closed position to cover a rear region, relative to the direction of travel, of the high-pressure cleaning apparatus between the two water storage tanks, and to uncover it in the open position. This rear region may for example receive tanks for cleaning agent, antifreeze and/or decalcifying agent and also hose drums for a pressure hose and/or an inlet hose and an electric switch cabinet and also receptacles for accessory parts for the high-pressure cleaning apparatus.

Preferably the at least one cover in its closed position rests on the two water storage tanks.

The at least one cover is mounted movably on the two water storage tanks. For example, provision may be made for the at least one cover to be mounted to be pivotable about a pivot axis oriented perpendicularly to the direction of travel on a first and a second bearing element, the first bearing element being formed on the first water storage tank and the second bearing element being formed on the second water storage tank, and the two bearing elements facing each other. With such a configuration, the two water storage tanks have at least one bearing element in each case. The bearing elements are oriented flush with each other and define a pivot axis for a cover rotatably mounted on the bearing elements, which in its closed position covers a region between the two water storage tanks.

In an advantageous embodiment of the invention, the two water storage tanks have in each case an extension arm oriented vertically upwards, on the upper end region of which is remote from the chassis at least one bearing element is formed.

It is particularly advantageous if the high-pressure cleaning apparatus has a front and a rear cover, the two covers being mounted on bearing elements, which are arranged adjacent to each other, of the two water storage tanks. The front cover in its closed position may cover the pump and the motor of the high-pressure cleaning appliance and also a heating unit for the water pressurized by the pump, and the rear cover in its closed position may cover an operating region in which for example a spray lance and a spray gun are arranged and also a high-pressure hose, to the free end of which the spray lance can be connected.

The bearing elements are preferably configured as pivot pins.

The description below of an advantageous embodiment of the invention serves to explain it in greater detail in conjunction with the drawings.

DETAILED DESCRIPTION OF THE INVENTION

Figure 1:
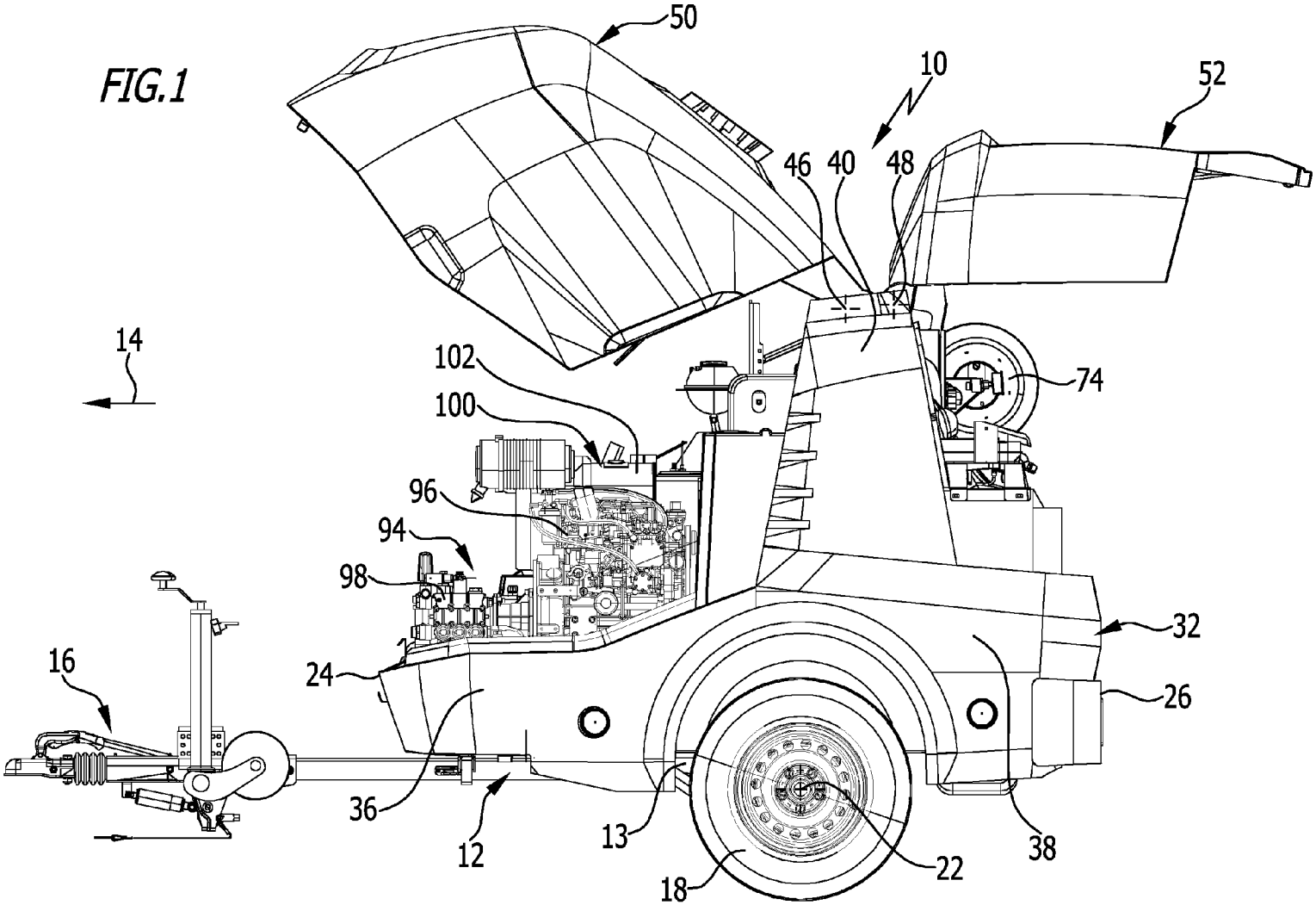
FIG. 1 is a schematic side view of a high-pressure cleaning apparatus according to the invention with an opened front cover and an opened rear cover.

In the drawings, an advantageous embodiment of a high-pressure cleaning apparatus according to the invention, which is assigned overall the reference numeral 10, is illustrated schematically. The high-pressure cleaning apparatus 10 is designed in the manner of a vehicle trailer which has a chassis 12 with a frame 13 which is connected rigidly to a drawbar 16 projecting forwards from the chassis 12 in the direction of travel 14 and on which two running wheels 18, 20 are mounted to be rotatable about a common axis of rotation 22. The high-pressure cleaning apparatus 10 has a front side 24 facing the drawbar 16, a rear side 26 remote from the drawbar 16 and also a first long side 28 and a second long side 30 which extend in the direction of travel 14 from the rear side 26 to the front side 24.

The high-pressure cleaning apparatus 10 has a first water storage tank 32 which is arranged on the first long side 28 and extends from the rear side 26 over the entire length of the chassis 12 to the front side 24. Furthermore, the high-pressure cleaning apparatus 10 has a second water storage tank 34 which is arranged on the second long side 30 and extends from the rear side 26 over the entire length of the chassis 12 to the front side 24. The first water storage tank 32, just like the second water storage tank 34, is located directly on the chassis 12. The chassis 12 to this end may have in the region of the first long side 28 a first longitudinal spar, on which the first water storage tank 32 is located, and in the region of the second long side 30 the chassis 12 may have a second longitudinal spar, on which the second water storage tank 34 is located directly. The longitudinal spars are not shown in the drawings in order to obtain a better overview.

The two water storage tanks 32, 34 have in each case a front tank region 36 and a rear tank region 38. The front tank region 36 extends from the front side 24 to approximately the axis of rotation 22 of the two running wheels 18, 20, and the front tank region 36 is adjoined by the rear tank region 38, which extends as far as the rear side 26. The rear tank region 38 forms an extension arm 40 oriented vertically upwards, which defines the maximum height of the high-pressure cleaning apparatus 10. On the upper end of the extension arm 40 are formed a front pivot pin 42 and a rear pivot pin 44. The front pivot pins 42 of the two water storage tanks 32, 34 face each other, are oriented flush with each other and define a front pivot axis 46. The rear pivot pins 44 of the two water storage tanks 32, 34 likewise face each other, are oriented flush with each other and define a rear pivot axis 48. On the front pivot pin 42 of the two water storage tanks 32, 34 a front cover 50 is mounted so as to be pivotable about the front pivot axis 46 and detachable, and on the rear pivot pin 44 of the two water storage tanks 32, 34 a rear cover 52 is mounted so as to be pivotable about the rear pivot axis 48 and detachable. The two covers 50, 52 can be pivoted back and forth between a closed position, in which they cover a space between the two water storage tanks 32, 34, and an open position, in which they uncover the space between the two water storage tanks 32, 34. If required, the covers 50, 52 can be removed completely from the water storage tanks 32, 34.

Figure 2:
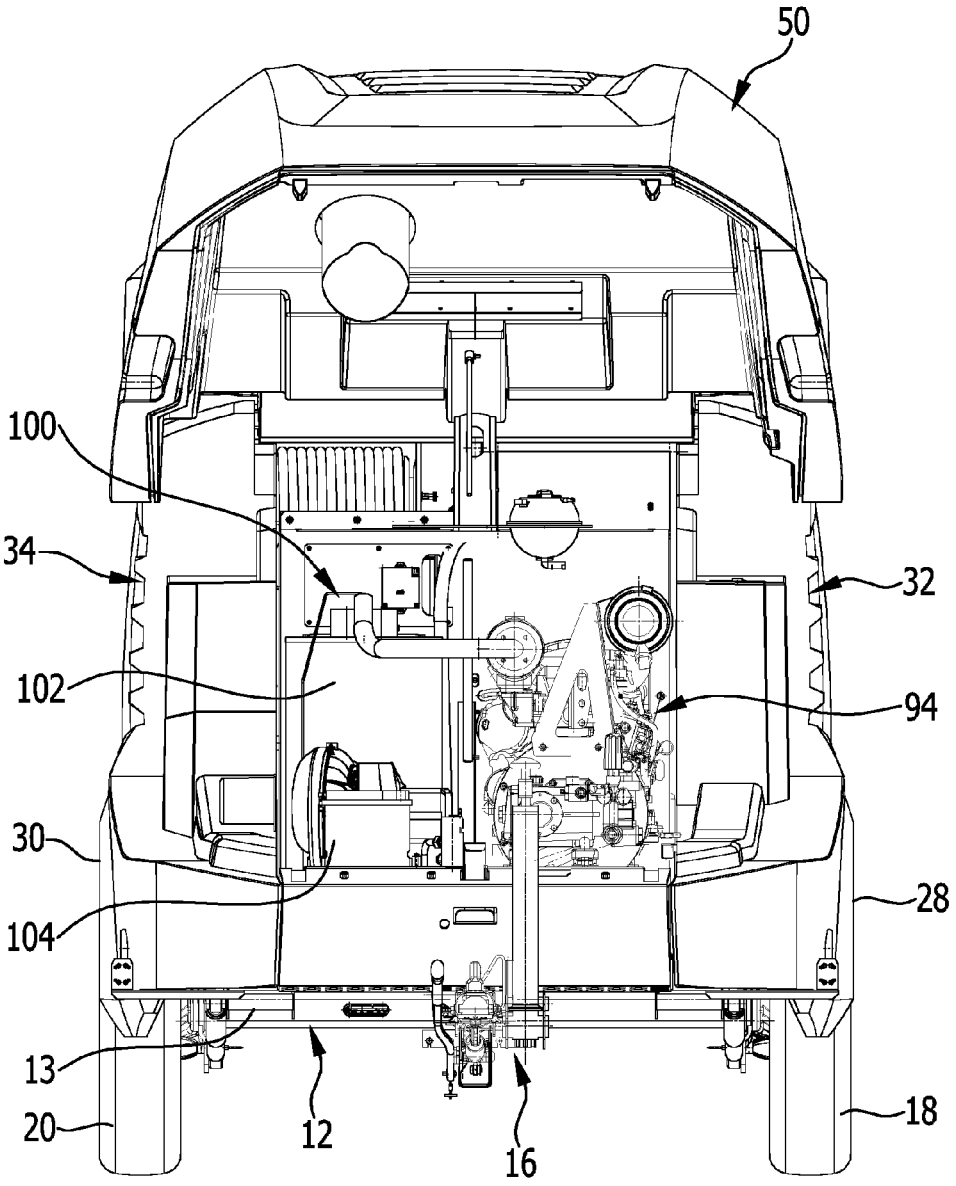
FIG. 2 is a front view of the high-pressure cleaning apparatus of FIG. 1 with the front cover opened.
Figure 3:
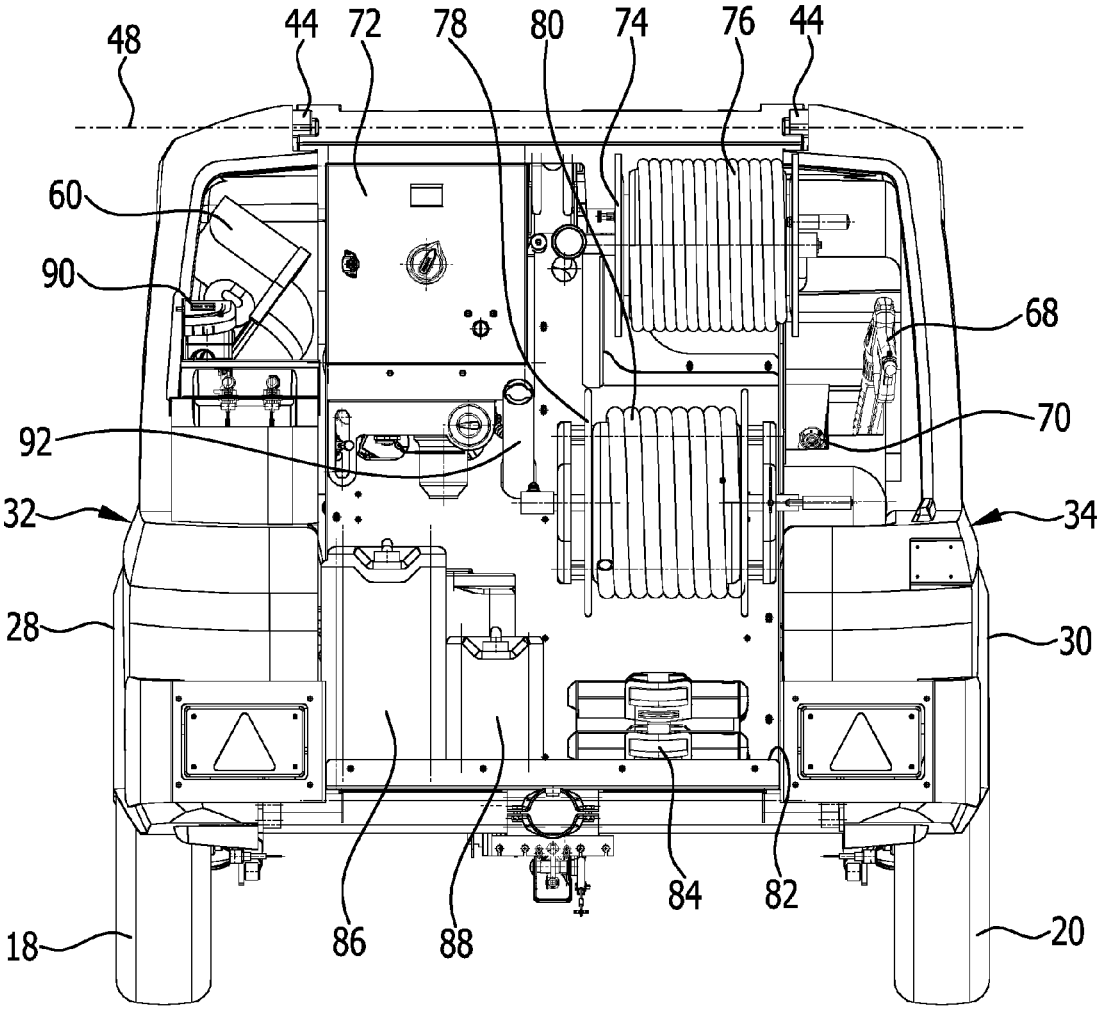
FIG. 3 is a rear view of the high-pressure cleaning apparatus of FIG. 3, the rear cover having been removed.
Figure 4:
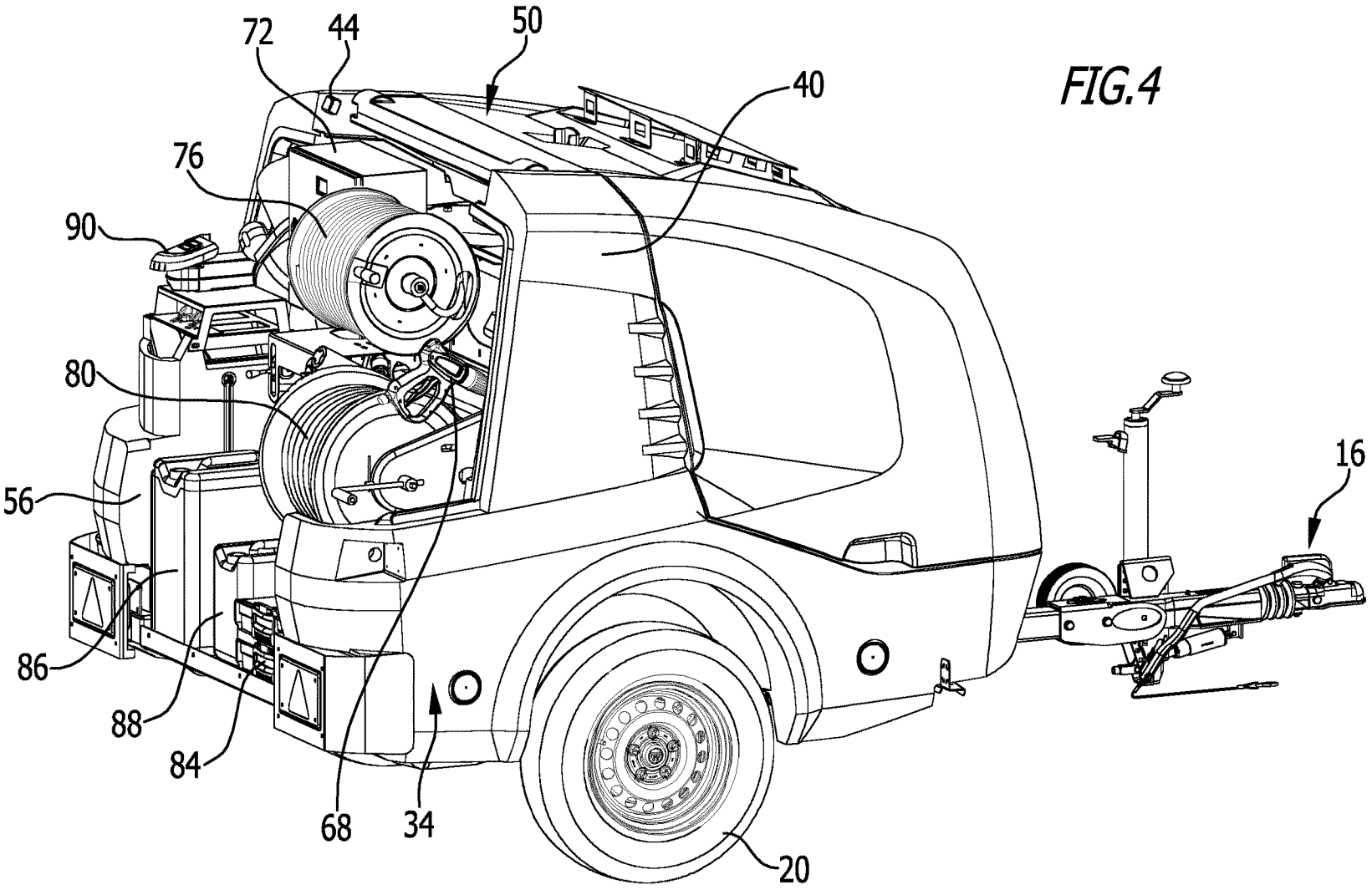
FIG. 4 is a perspective view of the high-pressure cleaning apparatus of FIG. 1 with the front cover closed and the rear cover removed.
Figure 5:
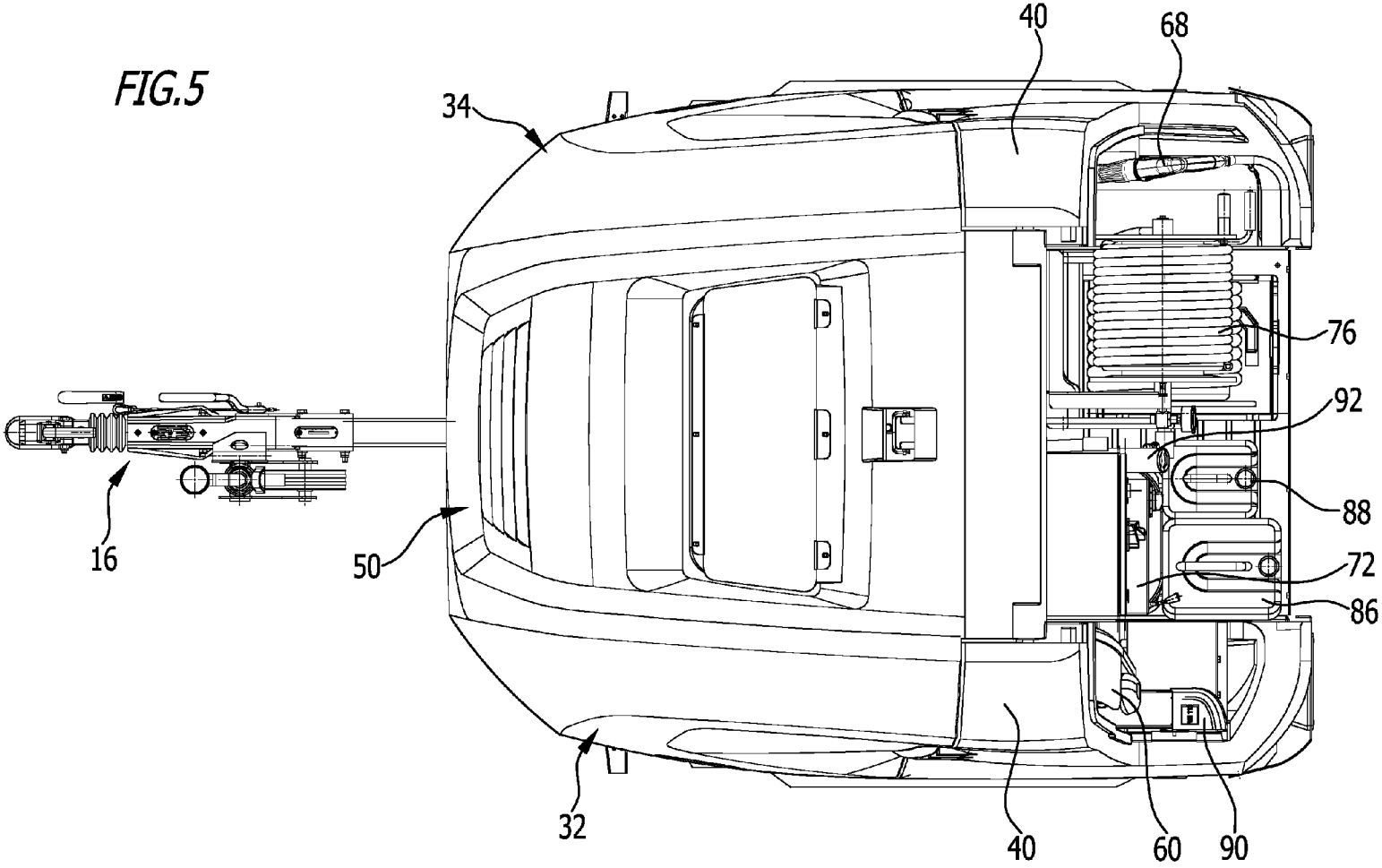
FIG. 5 is a top view of the high-pressure cleaning apparatus of FIG. 1 with the front cover closed and the rear cover removed.
Figure 6:
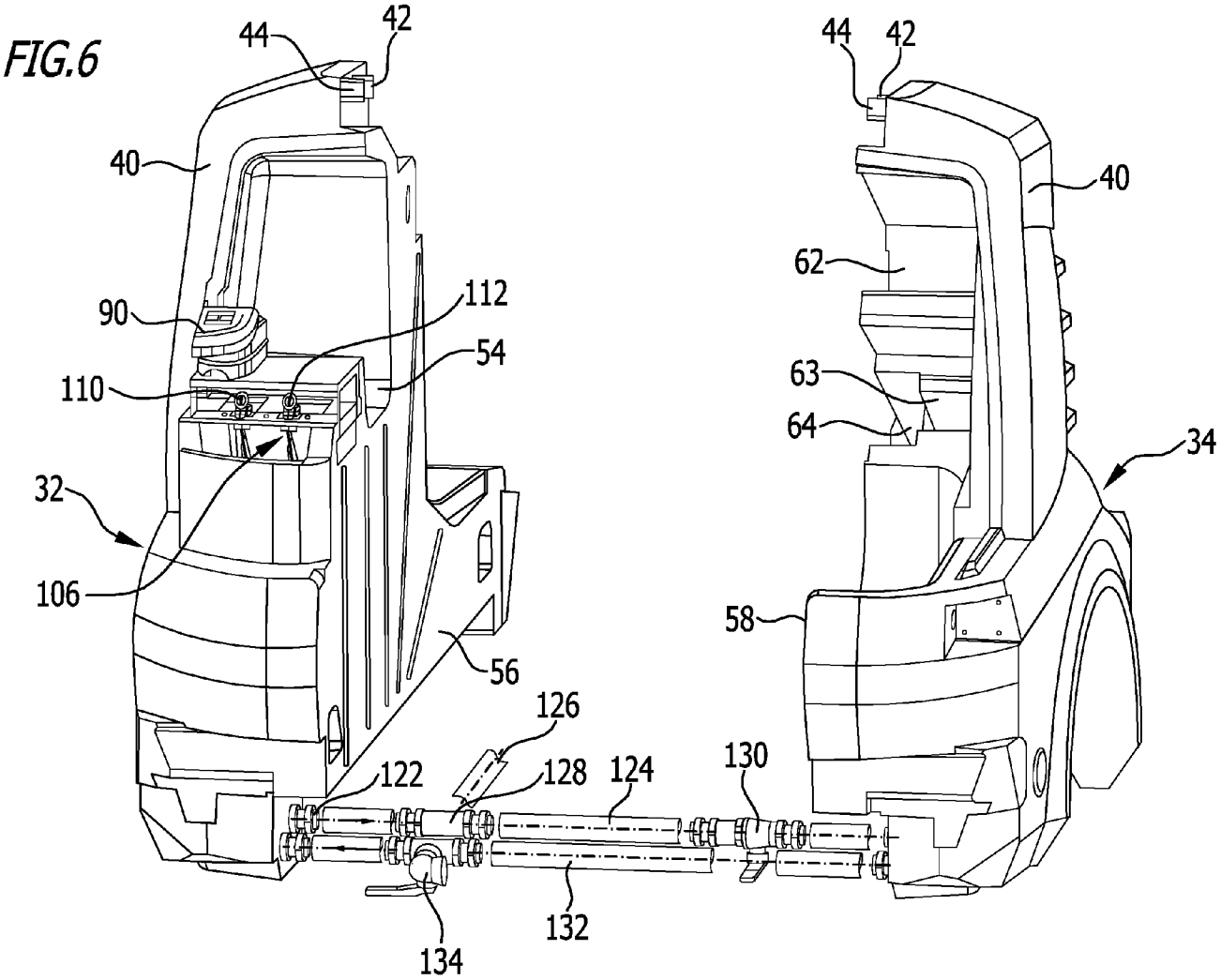
FIG. 6 is a perspective view of a first and a second water storage tank of the high-pressure cleaning apparatus of FIG. 1, the two water storage tanks being connected together via a line arrangement.
Figure 8:
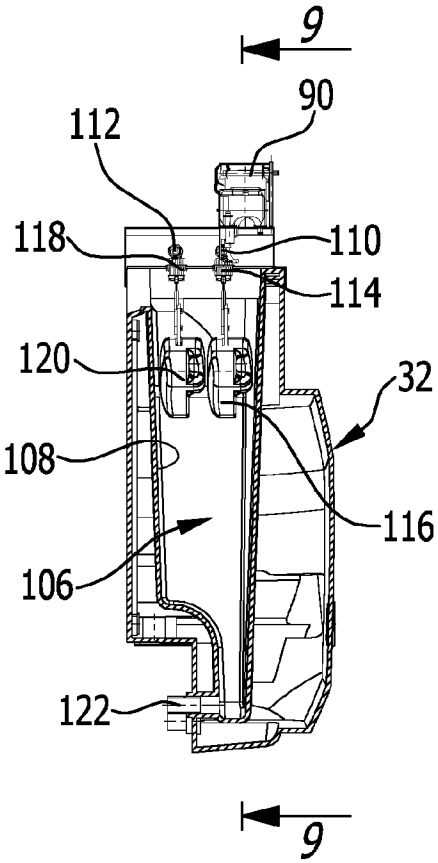
FIG. 8 is a sectional view of the first water storage tank along the line 8-8 in FIG. 7.
Figure 7:
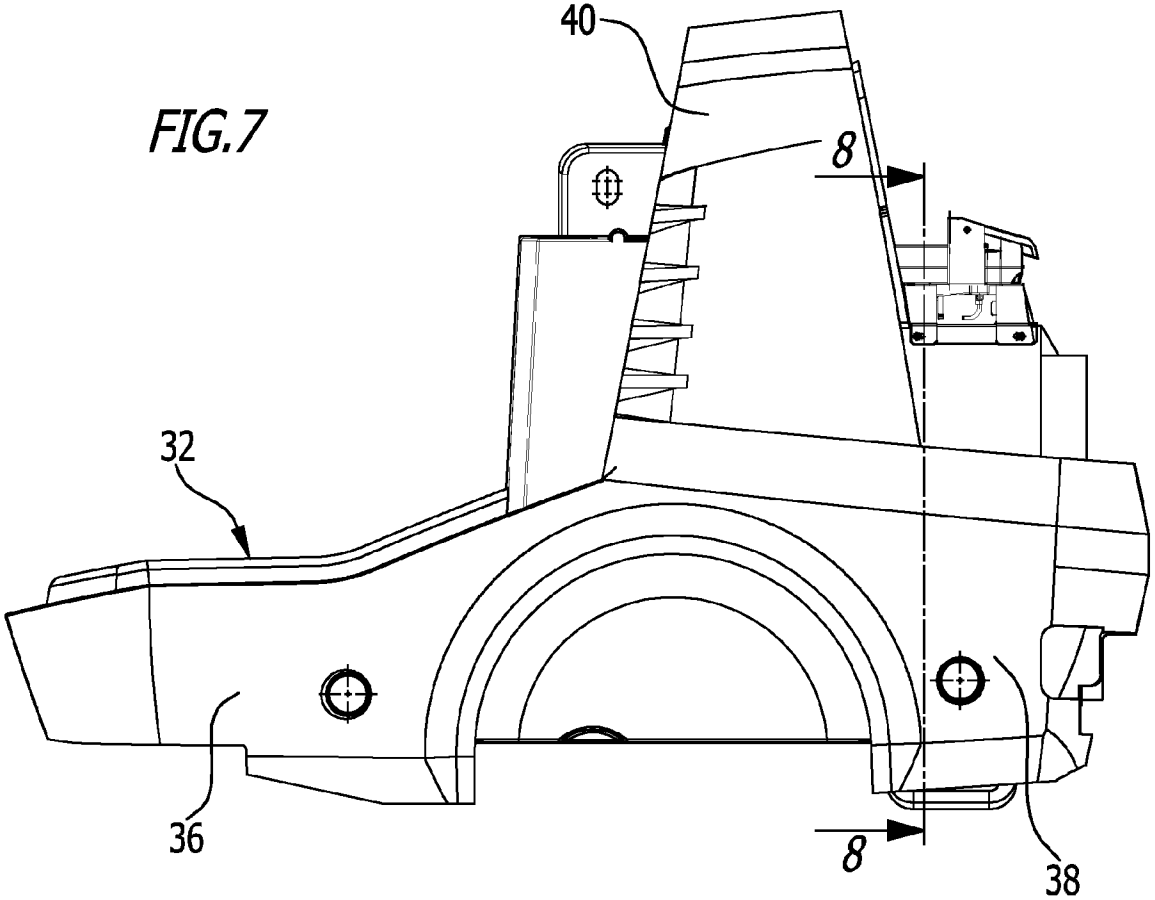
FIG. 7 is a schematic side view of the first water storage tank of FIG. 6.
Figure 9:
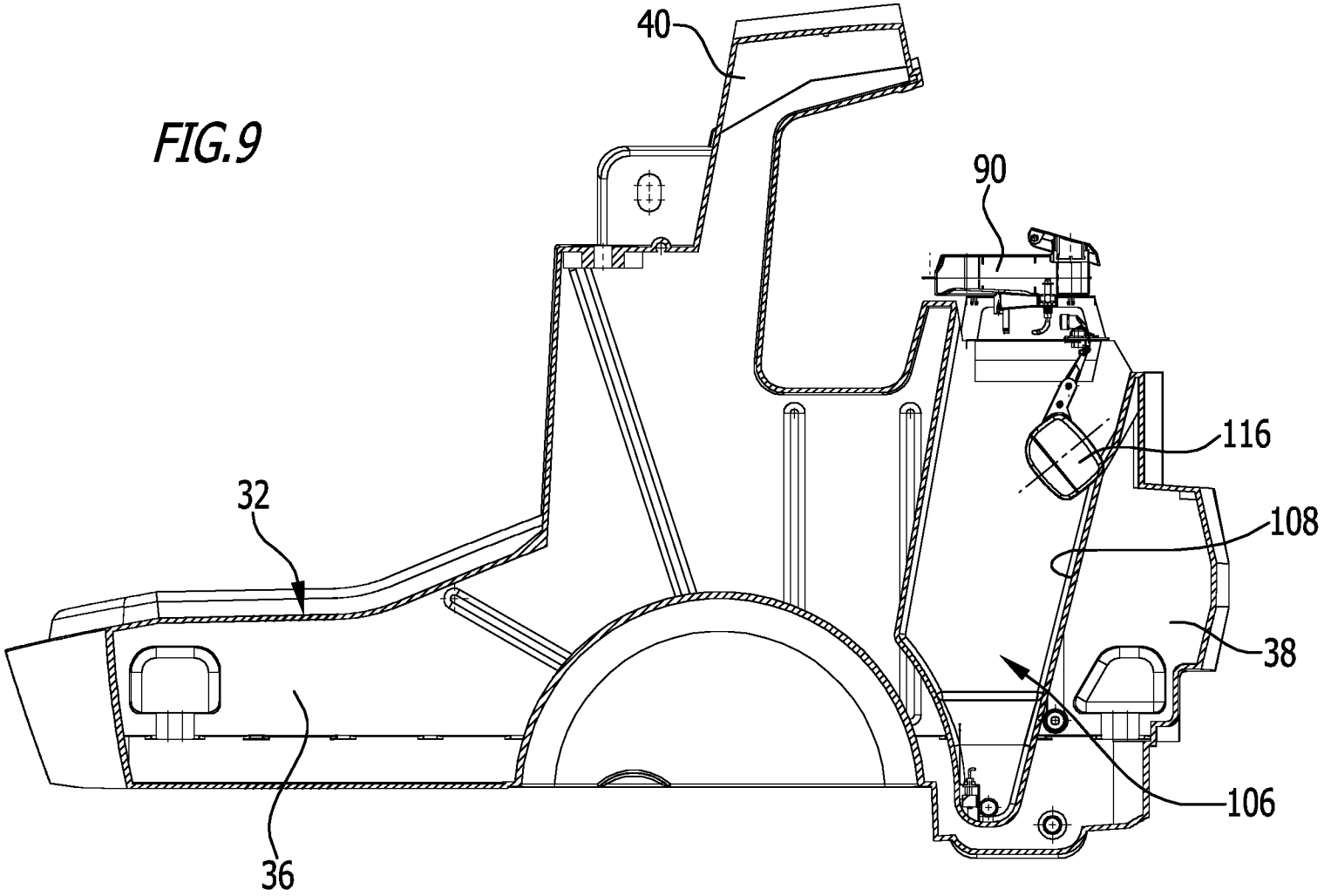
FIG. 9 is a sectional view of the first water storage tank along the line 9-9 in FIG. 8.

The front cover 50 is shown in its open position in FIGS. 1 and 2 and in its closed position in FIGS. 4 and 5. The rear cover 52 is shown in its open position in FIG. 1 and the rear cover 52 has been removed in FIGS. 3, 4 and 5.

In the region of the extension arm 50 there is molded into the first water storage tank 32 a first recess 54 which opens into an inner wall 56 of the first water storage tank 32. The inner wall 56 of the first water storage tank 32 faces an inner wall 58 of the second water storage tank 34. A safety helmet 60 for example can be positioned in the first recess 54.

The second water storage tank 34 has, approximately at the level of the first recess 54 of the first water storage tank 32, a second recess 62 which faces the first water storage tank 32 and opens into the inner wall 58 of the second water storage tank 34. The second recess 62 forms a receptacle in which for example operating instructions can be positioned.

Beneath the second recess 62, the second water storage tank 34 has a third recess 63 and a fourth recess 64 which likewise open into the inner wall 58 of the first water storage tank 34 and are molded into the second water storage tank 34. The third recess 63 forms a receptacle for a jet pipe which is connected to a spray gun 68, and the fourth recess 64 forms a receptacle for an extension jet pipe 70 which can be attached to the jet pipe connected to the spray gun 68.

The recesses 62, 63 and 64, as has already been indicated, are molded into the water storage tanks 32, 34, the direction of demolding for the recesses 62, 63, 64 running perpendicularly to the direction of travel 14. The two water storage tanks 32, 34 are produced from a plastics material in a rotational sintering process.

In the region between the two water storage tanks 32, 34, an electric switch cabinet 72, a hose drum 74 for a high-pressure hose 76, a hose drum 78 for an inlet hose 80, a storage surface 82 for a toolbox 84 and also a cleaning-agent tank 86 and an antifreeze tank 88 are arranged between the rear tank regions 38, these all being accessible to the user in a simple manner from the rear side 26 of the high-pressure cleaning apparatus 10 when the rear cover 52 is opened. Furthermore, a fuel filler pipe 92 for a fuel tank is arranged in this region, this tank not being shown in the drawings in order to obtain a better overview. The first water storage tank 32 bears a decalcifying-agent tank 90 at its rear end.

Between the front tank regions 36 of the two water storage tanks 32, 34 are arranged a high-pressure cleaning appliance 94 with a motor 96 and a pump 98 driven by this motor 96, and also a heating unit 100 which succeeds the pump 98, which unit in the embodiment illustrated is designed as a fuel-operated continuous-flow heater 102 with which a fan 104 for supplying combustion air is associated. The high-pressure cleaning appliance 94, just like the heating unit 100, is arranged in the region between the two water storage tanks 32, 34 on the chassis 12.

The two water storage tanks 32, 34 in each case form a hollow body. A decoupling tank 106 in the form of an indentation 108 molded into the first water storage tank 32 is integrated in the first water storage tank 32. The decoupling tank 106 has a first inlet 110 and a second inlet 112. A first filling-level-dependent valve in the form of a first float valve 114 is connected to the first inlet 110. The first float valve 114 has a first float 116 which detects the filling level of the decoupling tank 106. A second filling-level-dependent valve in the form of a second float valve 118, which has a second float 120 with which the filling level of the decoupling tank 106 can be detected, is connected to the second inlet 112. The first inlet 110 and the second inlet 112 are arranged above the maximum filling level of the decoupling tank 106. If the filling level of the decoupling tank 106 reaches a maximum value, the first inlet 110 and the second inlet 112 are closed by the float valves 114, 118 so that water cannot pass into the decoupling tank via the inlets 110, 112 any more. For example the inlet hose 80 can be connected either to the first inlet 110 or alternatively to the second inlet 112, which hose can be connected by its free end to a water supply mains, in particular to a public water supply mains.

The decoupling tank 106 has an outlet 122 which is connected to the second water storage tank 34 via a first connecting line 124. From the first connecting line 124 there branches off a supply line 126 which is connected to the entrance of the pump 98, so that a flow connection between the decoupling tank 106 and the pump 98 of the high-pressure cleaning appliance 94 is provided via the supply line 126.

A T-joint 128 is inserted into the first connecting line 124 in order to connect the supply line 126 to the first connecting line 124. Between the T-joint 128 and the second water storage tank 34 a shut-off member which can be actuated by the user is inserted into the first connecting line 124, which member in the example of embodiment illustrated is designed as a stopcock 130. By means of the stopcock 130, the flow connection between the decoupling tank 106 and the second water storage tank 34 can be broken without thereby adversely affecting the flow connection between the decoupling tank 106 and the high-pressure cleaning appliance 94.

The second water supply tank 34 is in a flow connection with the first water supply tank 32 via a second connecting line 132. A purging cock 134 is inserted into the second connecting line 132, which cock can be actuated by the user in order to empty the two water storage tanks 32, 34 and the decoupling tank 106 if required.

The high-pressure cleaning apparatus 10 which is in the form of a vehicle trailer can be moved to different operating sites, in particular to different construction sites, with the aid of a towing vehicle. At the respective operating site, water can be pressurized by means of the high-pressure cleaning appliance 94 and directed at an object via the pressure hose 76. The water which is pressurized by the pump 98 of the high-pressure cleaning appliance 94 can be heated by means of the heating unit 100. If a water supply mains is available at the respective operating site, water can be taken from the water supply mains via the inlet hose 80, which water can flow into the decoupling tank 106 and be supplied therefrom to the high-pressure cleaning appliance 94 via the supply line 126. The user in this case can close the stopcock 130, so that the water cannot pass from the decoupling tank 106 into the water storage tanks 32, 34.

To improve the cleaning result, a liquid cleaning agent, for example a soap solution, can be admixed to the water, which solution can be stored in the cleaning-agent tank 86. In order to avoid deposition of lime in the heating unit 106, furthermore a decalcifying agent can be admixed to the water, which agent can be stored in the decalcifying-agent tank 90. If the high-pressure cleaning apparatus 10 is not being operated, then in the cold season the high-pressure cleaning appliance 94, just like all the water-receiving lines and hoses of the high-pressure cleaning apparatus 10, can be filled with an antifreeze which can be stored in the antifreeze tank 88.

If no water supply mains is available at the operating site of the high-pressure cleaning apparatus 10, the two water storage tanks 32, 34 can be filled with water beforehand at a collection point by supplying the water from the collection point via the decoupling tank 106 and the first connecting line 124 to the second water storage tank 34, and from it via the second connecting line 132 to the first water storage tank 32. The stopcock 130 is opened for this purpose. The decoupling tank 106, when the stopcock 130 is opened, forms a communicating system with the two water storage tanks 32, 34 via the first connecting line 124 and the second connecting line 132, the filling level of the decoupling tank 106 coinciding with the filling level of the two water storage tanks 32, 34. At the operating site, the water can then flow out of the water storage tanks 32, 34 via the connecting lines 124, 132 and the supply line 126 to the entrance of the pump 98 of the high-pressure cleaning apparatus 94 when the stopcock is opened.

The invention claimed is:

1. A mobile high-pressure cleaning apparatus with a vehicle trailer, on a chassis of which at least two running wheels are held so as to be rotatable about a common axis of rotation for moving the high-pressure cleaning apparatus, and with a high-pressure cleaning appliance having a motor and a pump driven by the motor for pressurizing water which can be directed at an object which is to be cleaned, and also with at least one water storage tank for storing water for the high-pressure cleaning appliance, wherein the high-pressure cleaning apparatus has a decoupling tank with at least one inlet which is adapted to be connected to a water supply mains, and with at least one outlet which is connected to the high-pressure cleaning appliance and to at least one water storage tank via a shut-off member which is adapted to be actuated by a user, wherein the high-pressure cleaning apparatus has a first water storage tank and a second water storage tank which are arranged spaced apart from each other in each case on a long side of the vehicle trailer and are connected together via a line arrangement, the first water storage tank being arranged on a first long side of the vehicle trailer and the second water storage tank being arranged on a second long side of the vehicle trailer and the two water storage tanks being located on the chassis and the high-pressure cleaning appliance being positioned between the two water storage tanks on the chassis, wherein the decoupling tank is integrated in the first water storage tank and is connected via a supply line to the high-pressure cleaning appliance and via a first connecting line which is adapted to be shut off to the second water storage tank, wherein the second water storage tank is connected via a second connecting line to the first water storage tank, and wherein the first water storage tank has an indentation which forms the decoupling tank.

2. The mobile high-pressure cleaning apparatus according to claim 1, wherein the chassis has a frame on which the first water storage tank and the second water storage tank are located.

3. The mobile high-pressure cleaning apparatus according to claim 1, wherein the first water storage tank and the second water storage tank extend over the entire length of the chassis.

4. The mobile high-pressure cleaning apparatus according to claim 1, wherein at least one of the two water storage tanks has, facing the other water storage tank, at least one recess which forms a receptacle for an accessory part of the high-pressure cleaning appliance.

5. The mobile high-pressure cleaning apparatus according to claim 1, wherein the high-pressure cleaning apparatus has a heating unit for heating the water pressurized by the pump, the heating unit being arranged on the chassis between the two water storage tanks.

6. The mobile high-pressure cleaning apparatus according to claim 5, wherein the heating unit is configured as a fuel-operated continuous-flow heater.

7. The mobile high-pressure cleaning apparatus according to claim 1, wherein a fuel tank, a cleaning-agent tank and/or an antifreeze tank are arranged between the two water storage tanks.

8. The mobile high-pressure cleaning apparatus according to claim 7, wherein the fuel tank, the cleaning-agent tank and/or the antifreeze tank are accessible to the user from the rear side of the high-pressure cleaning apparatus.

9. The mobile high-pressure cleaning apparatus according to claim 1, wherein a high-pressure hose wound onto a hose drum and/or an inlet hose wound onto a hose drum are arranged between the two water storage tanks.

10. The mobile high-pressure cleaning apparatus according to claim 9, wherein the high-pressure hose and/or the inlet hose are accessible to the user from the rear side of the high-pressure cleaning apparatus.

11. The mobile high-pressure cleaning apparatus according to claim 1, wherein an electric switch cabinet and/or a storage surface for a toolbox are arranged between the two water storage tanks.

12. The mobile high-pressure cleaning apparatus according to claim 11, wherein the switch cabinet and/or the storage surface for the toolbox are accessible to the user from the rear side of the mobile high-pressure cleaning apparatus.

13. The mobile high-pressure cleaning apparatus according to claim 1, wherein the high-pressure cleaning apparatus has at least one cover which is movable back and forth between a closed position and an open position, which in the closed position covers a region between the two water storage tanks and uncovers this region in the open position, and which is mounted movably on the two water storage tanks.

14. The mobile high-pressure cleaning apparatus according to claim 13, wherein the at least one cover is mounted to be pivotable about a pivot axis oriented perpendicularly to a direction of travel on a first and a second bearing element, the first bearing element being formed on the first water storage tank and the second bearing element being formed on the second water storage tank, and the two bearing elements facing each other.

15. The mobile high-pressure cleaning apparatus according to claim 14, wherein the two water storage tanks have in each case an extension arm oriented vertically upwards, on the upper end region of which is remote from the chassis the bearing elements are formed.

16. The mobile high-pressure cleaning apparatus according to claim 14, wherein the bearing elements are configured as pivot pins.

* * * * *